US005944221A

United States Patent [19]

Laing et al.

[11] Patent Number: 5,944,221

[45] Date of Patent: Aug. 31, 1999

[54] INSTANTANEOUS HOT WATER DELIVERY SYSTEM WITH A TANK

[76] Inventors: Karsten Andreas Laing; Johannes Nikolaus Laing, both of 1253 La Jolla Rancho Rd., La Jolla, Calif. 92037

[21] Appl. No.: 09/016,917

[22] Filed: Feb. 2, 1998

[51] Int. Cl.[6] ..... B67D 5/08

[52] U.S. Cl. ..... 222/54; 222/250; 126/362; 4/598

[58] Field of Search ..... 4/675–678, 546, 4/598; 126/362; 137/337; 417/32; 222/54, 249, 250; 138/31

[56] References Cited

U.S. PATENT DOCUMENTS 3,483,666 12/1969 Harmes et al. ..... 222/250

5,042,524 8/1991 Lund ..... 126/362

*Primary Examiner*—Henry J. Recla

*Assistant Examiner*—Tuan Nguyen

[57] ABSTRACT

In a hot and cold water distribution system wherein the hot water is delivered from a water heater to a distant hot water tap adjacent a cold water tap, a hot water recirculation pump assembly purges the hot water line of any cooled-down water in order to assure instant hot water delivery when the hot water tap is opened. The volume of water drawn from the hot water line is flushed back through the hot water line by admission of an equal amount of water that was stored within a tank. That volume of water is pumped back into the tank, and automatically replaced by hot water drawn from the water heater.

15 Claims, 2 Drawing Sheets

Fig. 3
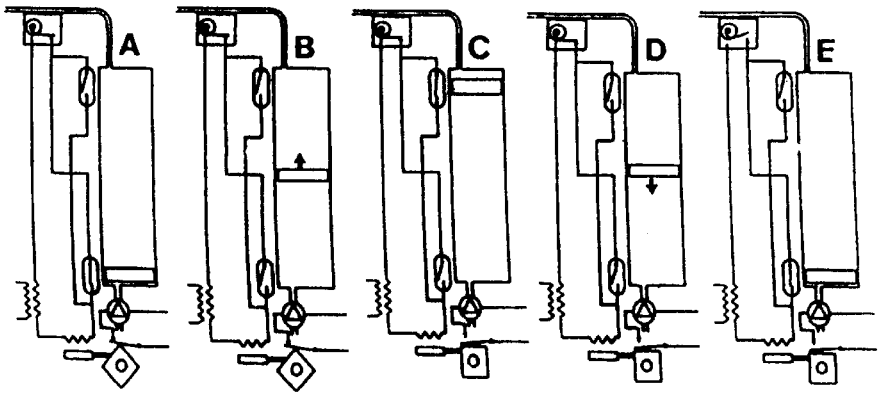
FIG. 5
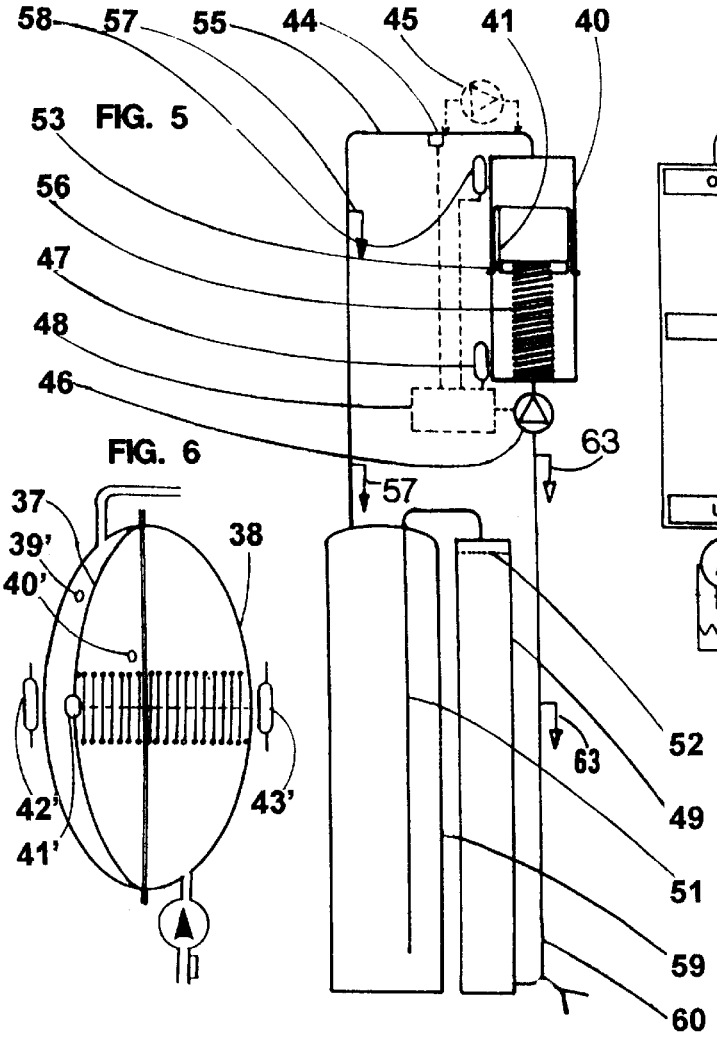
Fig. 4
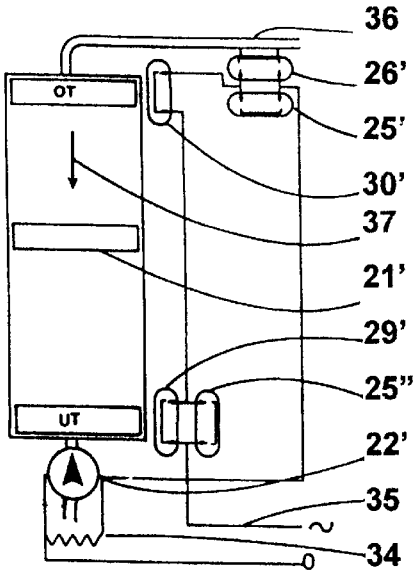
FIG. 6

INSTANTANEOUS HOT WATER DELIVERY SYSTEM WITH A TANK

FIELD OF THE INVENTION

The invention relates to a hot water distribution installation, and more specifically to a system with a pump and a tank for assuring instantaneous hot water delivery from a hot water tap.

BACKGROUND OF THE INVENTION

Circulating systems are known in which the cooled down water content of the hot water circulation line is conveyed back into the hot water tank via a recirculation pipe as disclosed in our earlier U.S. Pat. No. 5,143,049. Subsequent retrofit of a recirculation system requires additional piping which may be difficult to install. A different ferent hot water recovery system is disclosed in U.S. Pat. No. 5,009,572 Imhoff et al. and U.S. Pat. No. 5,277,219 Lund, in which a pump 46 has to be switched on if the hot water temperature near the faucet drops below a pre-determined level or is switched on as soon as a hot water faucet is opened. To economize the hot water usage the pump 46 conveys the cooled-down content of the hot water line back through the cold water line into the water heater. Thus the faucets in the distribution line receive warm water when the cooled-down water content between the water heater and the faucets has been pumped into the cold water line.

The aforesaid U.S. Pat. Nos. 5,009,572 Imhoff et al.; 5,143,049 Laing et al.; and 5,277,219 Lund are incorporated into this specification by this reference.

The prior art systems that recirculate the cooled-down portion of the hot water line directly through the cold water line have several drawbacks. The most serious is the fact that the cold water line is first filled with luke warm water. If cold water is needed right after a recirculation cycle, the user must wait several seconds for the heated water to be purged from the cold water line. Another drawback results from the fact that the warm water stream may build up scaling in the cold water line.

The present invention avoids these drawbacks.

SUMMARY OF THE INVENTION

The primary and secondary object of the invention are to improve the operation of a hot and cold water system distribution, and to assure an immediate supply of hot water to a hot water faucet by draining any cooled down water back into the hot water heater and immediately thereafter suck hot water from the hot water heater into the hot water line, and to prevent the drawing of hot water that has been purged from the hot water distribution line when a cold water faucet is turned on or that cold water from the cold water line flows into the hot water line when a hot water faucet is turned on, a tank is installed in series with the pump. This tank is divided into two areas separated by a movable wall which prevents the flow of water from the hot water line into the cold water line and vice versa.

The volume of cold water in the cold water area of the tank is flushed back through the cold water line into the inlet port of the water heater.

These and other valuable objects are achieved by means of a pump assembly combined with said tank installed between the hot water line and the cold water line.

BRIEF DESCRIPTION OF THE DRAWINGS

FIG. 3 shows the pump-tank-assembly in different modes;

FIG. 4 shows a tank assembly with different electrical elements;

FIG. 5 shows a system with two tanks;

FIG. 6 shows a tank with an oval cross-section

DESCRIPTION OF THE PREFERRED EMBODIMENTS OF THE INVENTION

Figure 1A:
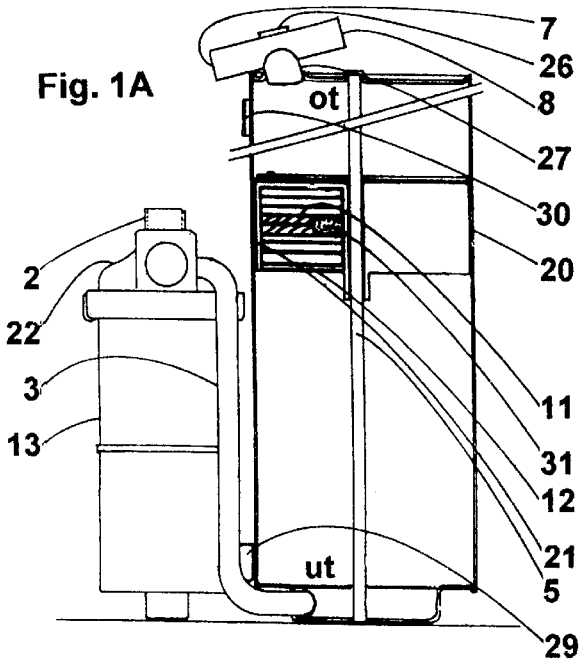
FIG. 1A shows a vertical cross-section through a tank.
Figure 1B:
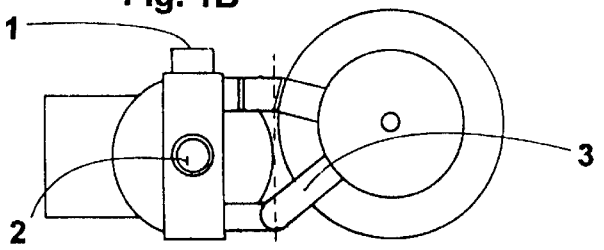
FIG. 1B shows the unit from above.
Figure 2:
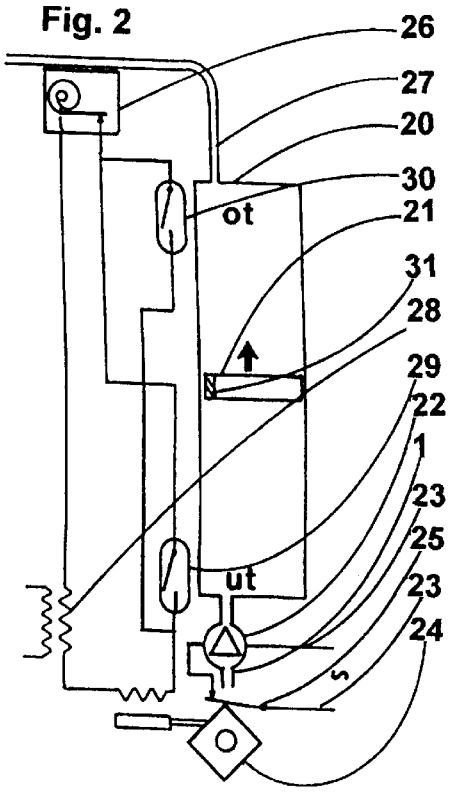
FIG. 2 shows the tank with the electric elements.

Referring now to the drawings, there is shown in FIG. 1A a vertical cross-section through a tank 20. FIG. 1B shows the unit from above, FIG. 2 shows the electric circuits. The hot water line ends at port 7. Outlet port 8 is connected to a hot water faucet. Pipe 3 connects the pump 22 with the lower part of the tank 20. The cold water line 1 is connected to the inlet port 2 of pump 22. Port 2 of the pump is connected to the cold water faucet 63. A temperature sensor 26 activates pump 22 as soon as the water temperature in the hot water line falls below a predetermined value. Now the pump conveys water from the cold water line into the lower region of the tank 20. In its center region the tank comprises a shaft 5 and a piston 21 sliding on that shaft 5. The cold water pumped into the tank moves the piston 21 upwards, thereby expelling the water content of the upper region of the tank 20 into the hot water line 27. As soon as the piston 21 reaches the top ot of the tank 20, a permanent magnet 31, integrated within the piston 21, activates the Reed-switch 30 which causes the step by step switch 23, 23 in FIG. 2 to rotate by 90°, whereby contact element 25 switches off the pump motor 13. Now the piston 21, which comprises heavy iron washer-shaped plates 11, moves downwards sucking hot water from the hot water heater, which fills the hot water line 27 and conveys the cooled down water from the hot water line 27 into the tank 20. At the same time, the water below the piston 21 is expelled into the cold water line 1, whereby the content of line 1 is conveyed through the inlet port into the water heater. The temperature of the hot water in the hot water line 27 opens thermo switch 26. As soon as the piston reaches the bottom ut of the tank 20, the Reed-contact 29 closes which enables temperature sensor 26 to energize the pump motor 13 as soon as the temperature of the water in the hot water line 27 falls below said predetermined temperature.

A transformer 28 energizes the step by step switch 23, 24. FIG. 3 shows the five consecutive steps of the cycle.

Position A shows the thermo-switch 26 closed due to the low water temperature in the hot water line, which causes the pump 22 to start stroke 1.

In position B the piston 21 has left the level ut whereby the Reed-switch 29 opens.

In position C the piston 21 reaches the top ot and closes Reed-switch 30, causing a 90° rotation of the cam 24, which opens the step by step switch thus stopping pump 22.

Now stroke 2 starts.

In position D the piston 22 moves downwards which opens Reed-switch 30.

Position E: As soon as the hot water filling in the hot water line 27 reaches thermostat 26, the thermostat opens, and the lower Reed-switch 29 closes.

After the water temperature in the hot water line 27 falls below the predetermined temperature, the cycle starts anew.

FIG. 4 shows a different electrical wiring, which achieves the same effect. As soon as the temperature in the hot water line 36 falls below a predetermined value thermo switch 26', being in good thermal contact to the hot water line, closes. The Reed-switch 29', connected to the power supply 35 is closed by the magnetic field of the magnet in piston 21'. Reed-switch 30' is also closed. Now pump 22' starts. At the same time the magnetically actuated contacts 25' and 25" are closed by coil 34. Thereafter thermo switch 26' may be open since there is a connection via contact 25'. As soon as the piston 21' leaves its position ut Reed-switch 29', which was held closed by the magnet in piston 21', opens. Contact 25" is switched in parallel to Reed-switch 29'. The connection to the power supply 35 now runs through Reed-switch 30' which is closed in idle position. As soon as the piston 21' reaches position ot, its magnetic field opens Reed-switch 30', thereby interrupting the power supply to the pump 22', which switches off. At the same time the contacts 25' and 25" open. Now the piston 21' starts descending in the direction of arrow 37 until it reaches its lowest position ut. Now the magnetic field of the piston 21' closes the Reed-switch 29'. 25" is open since the pump 22' switched off, Reed switch 30' is closed since it is in idle position. As soon as the temperature at the thermo switch 26' again falls below the predetermined value, the cycle starts anew.

In FIG. 5 a diaphragm 41 separates the warm water part of tank 40 from the cold water part in which a spring 56 draws the piston 53, which was moved by the pump pressure all the way to the warm water side, back into its starting position, after the pump 46 has conveyed the content of the tank 40 into the hot water line 55. Said diaphragm 41 follows the cylindrical wall of the tank and the inner portion of said diaphragm is able to roll into the outer portion of the diaphragm. The movable end of the diaphragm 41 is connected to piston 53. The cooled down content of the hot water line 55 has been pushed back into the water heater 59. After the pump 46 has been switched off, the spring 56 draws the piston 53 back towards the pump 46, which draws the warm water in the hot water line 55 into the tank 40. The volume of tank 40 is almost twice as large as the content of the hot water line 55 so that an equivalent amount of hot water ends up in the tank 40 before the piston 53 has reached its lowest position ut. The downwards movement of the piston 53 pushes the cold water content below the piston 53 through the cold water line 60 into a tall vessel 49, which has about the same volume as tank 40. At the same time the content of vessel 49 is conveyed into the water heater 59. If one of the warm water faucets 57 is opened cold water from the cold water line flows through vessel 49 into the water heater 59. As soon as thermostat 44 detects that the temperature of the hot water line 55 has fallen below the preset minimal temperature, processor 48 again activates pump 46. The pump 46 then conveys cold water from the vessel 49 through the cold water line 60 into tank 40. From the water heater 59 the same amount of water flows through the immersion tube 51 into the vessel 49 whereby a mesh 52 evenly distributes the incoming flow so that no mixing with the cold water takes place. As soon as the piston 53 has reached its highest position ot, the Reed-switch 58 switches off the pump. The Reed-contact 47 resembles the contact 29' in FIG. 4. This diagram not only prevents the mixture of warm and cold water in tank 40, but also assures that at all times, also during the cycles A to E, warm water will be in the hot water line 55, and that the cold water line will be filled with cold water at all times. The spring 56 can also be replaced by a weight as shown in FIG. 1 or by a second pump 45 arranged in the hot water line 55. To prevent the cooling down of the warm water content within tank 40, said tank should be insulated.

FIG. 6 shows a tank 38 with a membrane 37 situated therein which separates the warm water area 39' from the cold water area 40'. A permanent magnet 41' is integrated into the membrane 37, which magnet activates the Reed-switches 42', 43'.

We claim:

1. In a hot and cold water distribution system wherein hot water is distally delivered through a hot water line from a water heater to a hot water faucet, and cold water is delivered through a cold water line to said water heater and to a cold water faucet proximate to said hot water faucet, and a pump assembly is provided proximate said faucets between said cold and hot water lines to replace cooled-down water of said hot water line by hot water of said water heater, an improvement which comprises:

a tank connected in series with said pump comprising a movable wall separating the hot water content inside the tank from the cold water content;

a temperature sensor positioned to sense the water temperature proximate to the end region of said hot water line;

a control unit for activating the pump when said water temperature falls below a predetermined level.

2. The improvement of claim 1, wherein said movable wall comprises a permanent magnet and wherein the extent of its motion in a first stroke allows almost the whole tank to be filled with water from said cold water line, and that at the end of a second stroke almost the whole tank is filled with water from said hot water line, and whereby on the outside wall of said tank two magnetically actuated switches are attached.

3. The improvement of claim 2, wherein said tank is of cylindrical shape and wherein said movable wall is in the form of a piston.

4. The improvement of claim 3, wherein said piston is sliding along a shaft running through the center of the tank keeping the piston concentrically to the inside of the tank.

5. The improvement of claim 3, whereby in a first upward stroke the piston, moved by the pump pressure, pushes the warm water content of the tank through the hot water line into the water heater, and whereby in said second downward stroke the piston sucks hot water through the hot water line into the tank.

6. The improvement of claim 5, whereby during said second stroke said piston is moved by a second pump, arranged between the hot water line and said tank.

7. The improvement of claim 5, whereby during said second downward stroke said piston is moved by gravity.

8. The improvement of claim 5, whereby during said second downward stroke the piston is moved by the force of a spring.

9. The improvement of claim 2, wherein said movable wall is formed by a flexible diaphragm.

10. The improvement of claim 9, wherein said diaphragm extends along a portion of the inner surface of said cylindrical tank and whereby the open end of the diaphragm is connected to a piston, whereby said piston and the diaphragm can slip inside the remaining portion of said cylindrical diaphragm.

11. The improvement of claim 2, wherein said magnetically actuated switch is a Reed-switch.

12. The improvement of claim 11, wherein the Reed-switch proximate to the cold water line is switched in parallel to said magnetically actuated switch.

13. The improvement of claim 12, wherein the Reed-switch proximate to the hot water inlet of the tank opens when the piston reaches its uppermost position in the tank.

14. The improvement of claim 1, wherein the hot and cold water distribution system comprises:

said water heater with an inlet port and an outlet port;

said hot water line, one end of which is connected to said outlet port of the water heater, and the other end to a distant tank;

said pump mounted between said tank and said cold water line;

a vessel, proximate to said water heater, mounted between said cold water line and the inlet port of the water heater.

15. The improvement of claim 1, wherein said temperature sensor is switched in parallel to a magnetically actuated switch.

* * * * *